United States Patent [19]

Rhodes et al.

[11] 4,206,492

[45] Jun. 3, 1980

[54] ELECTRIC GAS IGNITOR UTILIZING A FIBER IGNITION ELEMENT

[75] Inventors: William H. Rhodes, Lexington; Paul O. Haugsjaa, Acton; John C. Gustafson, Waltham, all of Mass.

[73] Assignee: GTE Laboratories Incorporated, Waltham, Mass.

[21] Appl. No.: 658,447

[22] Filed: Feb. 17, 1976

[51] Int. Cl.[2] ..... H01C 3/00

[52] U.S. Cl. ..... 361/264; 219/270; 431/258; 431/263; 431/191

[58] Field of Search ..... 431/258, 262, 259, 263; 317/98; 219/260, 267, 270, 553, 552; 361/264

[56] References Cited

U.S. PATENT DOCUMENTS

| | | | |
|---|---|---|---|
| 3,393,038 | 7/1968 | Burkhalfer et al. | 317/98 X |
| 3,521,213 | 7/1970 | Hardy | 219/270 X |
| 3,538,231 | 11/1970 | Newkirk et al. | 219/553 X |
| 3,569,787 | 3/1971 | Palmer | 431/262 |
| 3,810,734 | 5/1974 | Willson | 431/258 |

*Primary Examiner*—Henry C. Yuen
*Assistant Examiner*—Harold Joyce
*Attorney, Agent, or Firm*—Fred Fisher

[57] ABSTRACT

An electric gas ignitor is disclosed having a gas igniting fiber comprising a core of conductive refractory material and an outer, high strength, oxidation resistant coating. One aspect of the invention concerns a primary current path defined by at least a portion of the fiber core and comprising a material having a highly uniform resistance per unit length. A substantially uniform temperature distribution is thereby promoted on the fiber surface and the formation of localized "hot spots" is inhibited. The primary current path is preferably an anisotropic material having a preferred crystal orientation which uniformly conducts electricity along the fiber length.

6 Claims, 4 Drawing Figures

ELECTRIC GAS IGNITOR UTILIZING A FIBER IGNITION ELEMENT

FIELD OF THE INVENTION

This invention relates to the ignition of a combustible gas in consumer and industrial applications. More specifically, this invention relates to the ignition of combustible gas by electrical resistive heating devices.

Electrical ignitors have become an attractive alternative to the gas pilot lights traditionally used to ignite such gas heating systems as furnances, clothes dryers and ranges. Typically, the pilot light is on at all times and when the main supply is to be ignited, the operator merely activates a control valve which permits the gas to flow past the vicinity of the pilot light, whereby ignition occurs. Due to a growing awareness of the need for conserving fossil fuels, such as natural gas, serious consideration has been given to replacing the gas pilot light with an electrical ignitor. Because pilot lights are unneeded during periods when the gas heating system is not in use, and are largely unnecessary during those periods subsequent to ignition, an electrical ignitor conserves a large quantity of needlessly consumed gas.

As will be described below, the electrical ignitors heretofore proposed have suffered disadvantages which limited their widespread use. Generally, the lower operating costs favoring the conventional electrical ignitors over pilot lights have been offset by significantly higher manufacturing and installation costs, as well as by a lower reliability factor.

DESCRIPTION OF THE PRIOR ART

The ignition element of one known electrical gas ignitor consists of a helical, reaction-sintered silicon carbide (SiC) ignition element, having a density range of 75–85%, measuring about ⅜" diameter and 4" in length, including a mounting bracket. A central aluminum oxide ($Al_2O_3$) insulator gives the helical element a degree of rigidity. The device operates at any voltage between 90 V–132 V and at surface temperatures between 1,000° C. and 1,620° C., respectively, but requires a substantial 375 watts of energy while in use.

One disadvantage associated with this device is the relatively low strength of 10,000 PSI of the silicon carbide element which, coupled with its large mass, makes the element particularly susceptible to impact damage unless carefully handled. Many such devices have indeed been known to break during shipping. Secondly, the element is vulnerable to both internal and surface oxidation during operation which in time leads to failure to the element.

A second known electrical gas ignitor comprises an element formed as a loop of wire made of 90% molybdenum silicide ($MoSi_2$) and 10% binder, the wire being imbedded in a support of ceramic cement which, in turn, is surrounded by a plastic insulator.

One disadvantage which limits use of this ignitor is the substantial cost incurred by the need for a transformer to convert the normal 110 V line voltage to the required 2.5 V, necessitated by the low resistance of the wire. An additional problem relates to the oxidation resistance of the wire, which depends upon oxidation of a thin outer layer of the $MoSi_2$ to form an oxidation-resistant silicon oxide coating. Under temperature cycling, however, this coating spalls because of a thermal mismatch between the silicon oxide and $MoSi_2$, thereby exposing the wire to repeated oxidation which eventually depletes the $MoSi_2$, causing failure. An additional problem relates to the strength of the $MoSi_2$ wire. Although the materials room temperature bend strength of 64,000 PSI is better than the reaction-sintered SiC ignitor, its tensile strength at its operating temperature of 1,550° C. is only 142 PSI, thereby limiting its vibration and impact load bearing characteristics.

SUMMARY OF THE INVENTION

It is, therefore, an object of the present invention to provide an improved electric gas ignitor which avoids the disadvantages enumerated above.

It is a further object to provide an electrical ignitor of high reliability, having an ignition element with high material strength.

It is a still further object to provide an electric ignitor of high reliability having a highly oxidation resistant ignition element.

While the ignition elements of prior gas ignitors are formed by processes such as reaction sintering, which yield an irregular molecular structure that substantially limits the material strength of the ignition element, the present invention in its broadest aspect provides a gas ignitor comprising a fiber, and means for passing an electric current through the fiber to raise its temperature sufficiently to ignite a combustible gas contigious therewith, the fiber having a core formed from a conductive refractory material, and a coating of substantially fully dense oxidation resistant material formed upon the core by a coating process, such as chemical vapor deposition, which produces a regular and uniform molecular structure having a high material strength. The high strength coating must be formed from an oxidation resistant material which is non-volatile, i.e., will not evaporate, at the operating temperature of the ignitor.

Coatings having stable oxide phases at the operating temperature of the ignitor such as silicon carbide (SiC), molybdenum di-silicide ($MoSi_2$), and aluminum oxide ($Al_2O_3$) may be used. The term "stable oxide phase" is taken to mean that the outer surface of the materials form a protective oxide film which limits further oxidation of the coating or the core. Naturally, in the case of a material such as $Al_2O_3$, the coating itself is a stable oxide.

The term "conductive refractory material", used with respect to the fiber core, is taken to mean any conductive or semi-conductive material which is stable at the operating temperature of the gas ignitor and includes such material as carbon, tungsten, or molybdenum.

We have discovered that such fibers may be advantageously used as ignition elements for electrical gas ignitors owing to their high average tensile and bend strength, typically 480,000 PSI, which permits the use of small diameter fibers without degradation of impact load or vibration bearing characteristics. As will be discussed below, the ability to utilize small diameter fibers not only reduces the input power requirements of the gas ignitor, but permits the ignition element to reach operating temperatures quickly owing to the low thermal mass of the fiber.

An additional advantage provided by the instant invention is the improved oxidation resistance provided by the substantially fully dense coating of the described fiber. The formation of a substantially continuous oxide film on the substantially fully dense coating limits further oxidation to that caused by diffusion of oxygen through the oxide to the fresh coating surface. Generally, oxidation resistance of an electric ignitor element is dependent not only upon the continuity of the oxide film, but also upon the ability of the formed oxide to adhere to the coating surface during repeated temperature cycling: i.e., the degree of thermal matching between the oxide film and fiber coating. Experience has also shown that, in spite of differing coefficients of expansion, the adherence of the oxide film to the coating is enhanced as the fiber diameter is decreased, owing to the reduced differential between the dimensional changes undergone by the two repeatedly expanded materials.

In one embodiment, the fiber comprises a core of either tungsten or carbon, and a silicon carbide coating. It has been found that under operating conditions, the fully dense silicon carbide (SiC) coating provides inherently superior resistance to oxidation when compared to that of ignitor elements known in the art. It has been found that the oxide film formed on the SiC coating of the present invention has inherently superior adherence owing to the relatively close matching of thermal expansion coefficients for the formed $SiO_2$ film and the SiC coating. The superior matching of SiC and $SiO_2$ with temperature changes, coupled with the small diameter now attainable by by virtue of the present invention, provide excellent oxidation resistance.

To further improve the reliability of the subject ignitor, an intermediate layer of barrier material between the coating and the core is included to prevent the diffusion of the coating into the core material. Such diffusion increases the resistance of the fiber core, thereby decreasing the operating temperature over a period of time. Similarly, it is also desirable to inhibit the formation of localized "hot spots", varying by as much as 200° C. above the nominal fiber temperature, which tend to crack the fiber coating and thereby expose the core to oxidation.

For the sake of reliability, it is therefore desirable to inhibit the formation of hot spots and the diffusion of the silicon. The former requires a homogeneous core material providing uniform current flow, while the latter requires a layer of barrier material which inhibits ion migration across the boundary between core and coating. Thus, in another embodiment of the invention, the core comprises an anisotropic material oriented to provide homogeneous conduction along the fiber while inhibiting the diffusion of silicon into the core material. Alternatively, a layer of anisotropic material may be placed between the fiber core and coating in a manner described below. Accordingly, in the preferred embodiment, a carbon core is preferred owing to the ease with which pyrolytic graphite may be used as such an anisotropic material.

The invention together with further objects and advantages can be best understood with reference to the following detailed description, in conjunction with the drawings.

DESCRIPTION OF THE PREFERRED EMBODIMENTS

Figure 1:
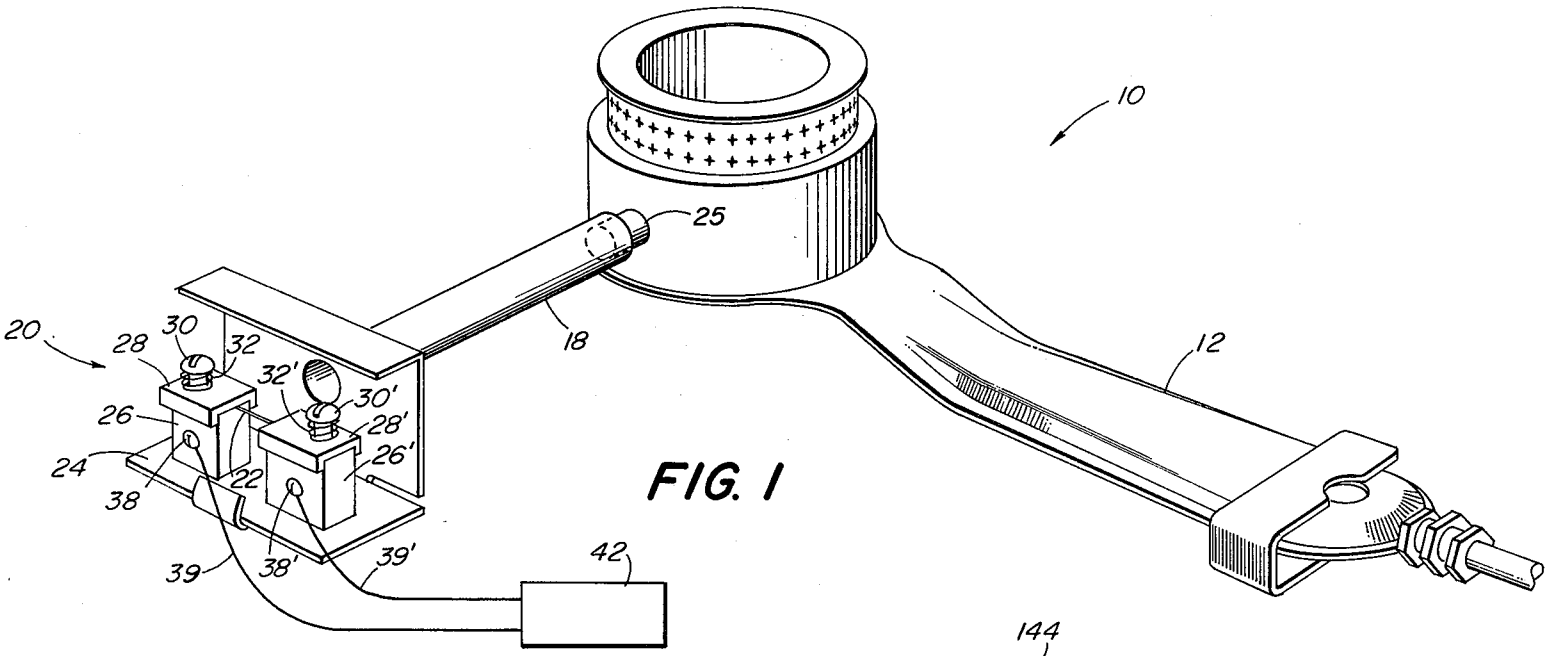
FIG. 1 is a perspective view of an electric gas ignitor in accordance with the invention and adapted for use in a gas range.

FIG. 1 is a perspective view of an electric gas ignitor made in accordance with the invention and adapted for automatic lighting of a gas range burner. A portion of a conventional gas range, is included for explanatory purposes. Although the operation of such ranges is well known in the art, a brief explanation follows for the sake of clarity.

Referring to FIG. 1, the main line 12 of the burner 10 is connected to a gas source through a manifold (not shown). A manually operated burner valve directs a gas/air mixture from the manifold to the burner 10 in response to rotation of a knob on the front of the range. Automatic ignition of the gas/air mixture is accomplished by an electric gas ignitor 20 in conjunction with a jet 25, which protrudes from the base of the burner 10, and a flashtube 18 which is concentrically mounted on the jet 25 and extends towards the ignitor 20. A quantity of gas is injected into the flashtube 18 by the jet 25 and is ignited as it approaches the ignitor 20. The slow velocity of the gas mixture within the flashtube enables the resulting flame to "flash" back to the burner and thereby ignite the gas mixture contained therein.

Turning now to the gas ignitor 20, and with further reference to FIG. 1, the ignitor comprises a non-conductive base 24 supporting a pair of upwardly extending conductive supports 26—26'. A conductive fiber 22 is spatially mounted between supports 26—26' with its ends secured thereto by clamps 28–28', which are fastened to the supports 26–26' by a pair of screws 30–30'. A pair of helical springs 32–32' are mounted concentrically around the shafts of the screws 30–30' to prevent the exertion of excessive compressional forces by the clamps which could crack the silicon carbide coating and thereby expose the inner portion of the coating, as well as the fiber core, to oxidation. The composition of the fiber 22 may be better understood with reference to FIG. 2.

Figure 2:
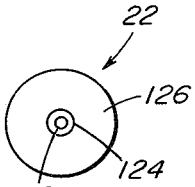
FIG. 2 is a cross-sectional view of the preferred gas igniting fiber for use in the electric gas ignitor in accordance with the invention.

FIG. 2 is a cross-sectional view of a preferred fiber for use in the electric gas ignitor according to the invention. In the preferred embodiment, the fiber 22 comprises an outer silicon carbide coating 126, and a core having a pyrolytic graphite layer 124 deposited on a carbon filament 122. The graphite layer 124 is an anisotropic material whose crystal structure is oriented to provide a substantially homogeneous current path along the fiber, while inhibiting inward diffusion of the silicon carbide coating 126. The homogeneity of the graphite yields a uniformly resistive current path and, consequently an even temperature distribution along the fiber, thereby inhibiting hot spot formation.

In practice, the pyrolytic graphite may be deposited on the carbon filament by a chemical vapor deposition (CVD) process, as shown in the art. The silicon carbide coating may be deposited onto the graphite in the same manner. Such fibers have been utilized for their mechanical properties in such applications as high strength metal matrices used for fiberglass re-inforcement, and may be obtained from such sources as AVCO Corporation.

It is of course understood that equivalent embodiments, such as fibers having homogeneous cores or other core-compatible intermediate materials may be used without departing from the spirit of the invention.

Returning to FIG. 1, the supports 26–26' are sized to support the fiber 22 at the focal point of the flashtube 18, where the gas mixture is essentially static, thereby substantially eliminating convectional cooling of the fiber by the gas flow and consequently allowing the fiber to be dimensioned to provide a low thermal mass capable of speedily reaching the required ignition temperature.

The method for determining the desired fiber dimensions is to first calculate the total of convectional and radiational heat losses (at the operating temperature) per unit length for a fiber having a tentatively selected diameter.

$$H_T = H_C + H_R \quad (1)$$

$$H_T = K(T_F = T_A) + E(T_F)T_F^4 \quad (2)$$

where $H_T$ = total heat loss per unit length $H_R$ = radiative heat loss per unit length $H_C$ = convectional heat loss per unit length K = convective constant $E(T_F)$ = emissivity $T_F$ = fiber temperature (°K)

$T_A$ = ambient temperature (°K)

Once the total unit length heat loss is known, the power required to balance the loss may also be calculated on a unit length basis as:

$$P = H_T \cdot L \quad (3)$$

where

L = Langmuir's coefficient $\approx \sqrt[4]{(v+25/25)}$

[(see Proc. Amer. Inst. Elect. Engineers; vol. 32, No. 391

P = power per unit length v = velocity of gas flow around the fiber (cm/sec.)

Owing to the almost static condition of the gas within the flashtube 18 of FIG. 1, the value of L (in equation 3) may be treated as unity.

Having the calculated value of unit power, the required voltage per unit length is simply:

$$V = \sqrt{PR} \quad (4)$$

where

V = voltage per unit length

R = resistance per unit length and the fiber length is:

$$l = (E/V) \quad (5)$$

where E = source voltage.

Returning to FIG. 1, attention is now turned to the manner in which the fiber 22 is energized. The fiber 22 is coupled to a control circuit 42 by the conductive supports 26–26' which, respectively, contact the ends of the fiber in a manner to be described. The supports, in turn, may each be coupled to the control circuit 42 by a variety of means such as a terminal comprising a threaded hole formed within the body of each support to accommodate a screw 38 which secures a lead 39 from the control circuit. Before the circuitry details of control circuit 42 are discussed, attention will be given to the manner by which electrical contact to the fiber 22 may be made.

Figure 3:
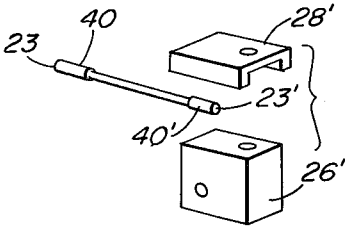
FIG. 3 is a perspective view in explosion showing the manner by which electrical contact with the fiber may be made.

FIG. 3 shows a perspective view in explosion showing the fiber and the manner by which electrical contact to the current-carrying core of the fiber may be conveniently made. Each end portion of the fiber 22 is individually coated with a conductive film 40–40', preferably copper, and by such a process as electroplating. The film 40–40' crosses the end face 23–23' of the fiber to contact the fiber core, and extends lengthwise along the end portion fiber to provide a conductive surface suitable for contact by the supports 26–26'. The conductive surface formed by the film should not extend past the inside edge of the supporting surface of supports 26–26', which functions as a heat sink to prevent a chemical reaction between the copper and the silicon carbide coatings at the operating temperature of approximately 1450° C.

Figure 4:
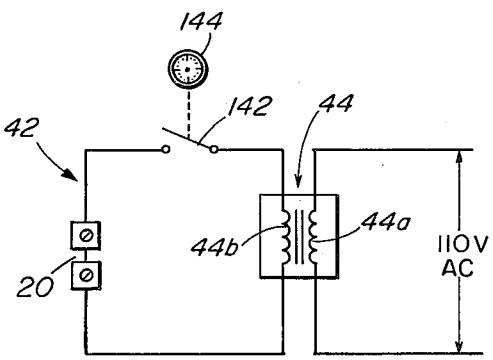
FIG. 4 is a schematic representation of an ignitor energizing circuit according to the invention.

FIG. 4 is a schematic of the control circuit 42 which may be utilized to selectively energize the ignitor. The series connected components of the circuit 42 comprise a switch 142, the fiber 22, and the secondary winding **44*b* of the transformer 44. Series connected conventional line voltage of 110*v* is applied to primary winding 44*a* of transformer 44 and stepped down to 65*v*** to lessen potential shock hazards resulting from tampering with the internal components of gas ranges. It may be noted that the use of a transformer to reduce shock hazards is a matter of choice. The fiber may alternately be energized directly by line voltage.

The switch 142 is coupled to the burner valve knob 144, located on the front of the range, so that the switch is closed by the manual rotation of the knob from its OFF position. Closure of the switch 142 places the secondary winding voltage across the ignitor 20, causing current to pass through the fiber core. Rotation of the knob to its OFF position opens the switch 142 to de-energize the fiber.

The object of the present invention has been accomplished, in the preferred embodiment, utilizing fibers having a length of 3.0 cm and comprising a 0.0039 inch (100 μm) O.D. silicon carbide coating with a core formed from a 0.0001 inch (2.5 μm) thick coating of pyrolytic graphite deposited on a 0.0010 inch (25.4 μm) carbon filament. When powered by a 65 v source, such fibers reach an operating temperature of 1450° C. in less than one second and possess lifetimes greater than 6,000 hours under continuous duty at the operating temperature. Five such fibers have been cycled at a rate of 13 seconds "on" and 13 seconds "off" in a gas range environment. One fiber, operated continuously but with the gas cycled on and off, survived $3 \times 10^4$ cycles. In the remaining four tests, wherein both the fiber and gas were cycled, the fibers survived over $5 \times 10^4$ ignitions and were in operation at completion of the testing. The mean time to gas ignition was two seconds with an ignition reliability better than 99.9%.

While what is considered a preferred embodiment of the invention has been shown and described, certain changes and modifications will be apparent to persons skilled in the art. Such changes and modifications may be made without departing from the spirit of the invention as defined by the appended claims.

We claim:

1. An electric gas ignitor for igniting a combustible gas comprising:

a fiber having (a) a core at least a portion of which defines a primary current path formed from an electrically conductive refractory material characterized by a highly uniform resistance per unit length, and (b) a substantially fully dense and non-volatile, oxidation resistant coating formed upon the core by a coating process which produces a substantially regular and uniform molecular structure; and means for passing an electric current through the primary current path to raise the fiber temperature sufficiently to ignite gas contiguous therewith, the conductive refractory material resistance per unit length being sufficiently uniform to create a substantially uniform temperature distribution along the fiber surface and inhibit hot spot formation, wherein the core includes a peripheral diffusion-barrier material means for inhibiting diffusion of the fiber coating and core, and wherein the barrier material means is an anistropic material having a preferred crystal orientation which both inhibits diffusion of the coating and the core, and also promotes a substantially uniform temperature distribution along the fiber length.

2. An electric gas ignitor for igniting a combustible gas comprising:

a fiber having (a) a core including a substrate, and a substrate coating forming the primary current path and characterized by a highly uniform resistance per unit length, wherein the coating formed on the substrate is an anisotropic material having its preferred crystal orientation in a direction which promotes uniform current flow along the fiber, and (b) a substantially fully dense and non-volatile, oxidation resistant coating formed upon the core by a coating process which produces a substantially regular and uniform molecular structure; and means for passing an electric current through the primary current path to raise the fiber temperature sufficiently to ignite gas contiguous therewith.

the conductive refractory material resistance per unit length being sufficiently uniform to create a substantially uniform temperature distribution along the fiber surface and inhibit hot spot formation.

3. An electric gas ignitor for igniting a combustible gas comprising:

a fiber having (a) a core at least a portion of which defines a primary current path formed from an electrically conductive refractory material characterized by a highly uniform resistance per unit length, said core comprising a substrate which is formed from carbon, and a substrate coating which is formed from pyrolytic graphite, forming the primary current path and characterized by a highly uniform resistance per unit length, and (b) a substantially fully dense and non-volatile, oxidation resistance coating formed upon the core by a coating process which produces a substantially regular and uniform molecular structure; and means for passing an electric current through the primary current path to raise the fiber temperature sufficiently to ignite gas contiguous therewith, the conductive refractory material resistance per unit length being sufficiently uniform to create a substantially uniform temperature distribution along the fiber surface and inhibit hot spot formation.

4. An electric gas ignitor for igniting a combustible gas comprising:

a fiber having (a) a core formed from a conductive refractory material, (b) a substantially fully dense and non-volatile, oxidation resistant outer coating formed upon the fiber by a coating process which produces a substantially regular and uniform molecular structure, and (c) a layer of diffusion-barrier material interjacent the core and outer coating for inhibiting the diffusion of coating material and the core; and means for passing an electric current through the fiber to raise its temperature sufficiently to ignite gas contiguous therewith.

wherein the barrier material is characterized by a refractory close-packed crystal structure and a dense microstructure, and wherein the barrier material comprises pyrolytic graphite.

5. The ignitor of claim 4 wherein the fiber core is carbon and the outer fiber coating is silicon carbide.

6. The ignitor of claim 5 wherein the graphite is deposited as a coating on the fiber core.

* * * * *